US005263612A

United States Patent [19]

Nederveld

[11] Patent Number: 5,263,612

[45] Date of Patent: Nov. 23, 1993

[54] FIBREBOARD CONTAINER FOR FRESH PRODUCE

[75] Inventor: Terrill L. Nederveld, Ada, Mich.

[73] Assignee: Packaging Corporation of America, Evanston, Ill.

[21] Appl. No.: 44,062

[22] Filed: Apr. 6, 1993

Related U.S. Application Data

[63] Continuation of Ser. No. 879,877, May 7, 1992, abandoned.

[51] Int. Cl.[5] ..... B65D 5/10

[52] U.S. Cl. ..... 229/112; 229/113; 229/120; 229/122; 229/162

[58] Field of Search ..... 229/112, 113, 120, 122, 229/DIG. 14, 162

[56] References Cited

U.S. PATENT DOCUMENTS

| | | | |
|---|---|---|---|
| 917,347 | 4/1909 | Neumann | 229/113 |
| 1,724,636 | 8/1929 | Bell | 229/112 |
| 2,398,797 | 4/1946 | Meyer et al. | 229/120 |
| 2,883,042 | 4/1959 | Richer | 229/113 |
| 2,923,455 | 2/1960 | Tingley | 229/113 |
| 3,660,116 | 5/1972 | Clark | 229/DIG. 14 |
| 3,695,505 | 10/1972 | Wolf | 229/162 |
| 3,863,829 | 2/1975 | Merrill | 229/112 |
| 3,881,648 | 5/1975 | Hall | 229/112 |
| 4,127,228 | 11/1978 | Hall | 229/113 |
| 4,313,547 | 2/1982 | Osborne | 229/120 |
| 4,353,495 | 10/1982 | Jes | 229/112 |
| 4,529,117 | 7/1985 | Brundage | 229/113 |
| 5,014,905 | 5/1991 | Cassidy | 229/122 |

*Primary Examiner*—Gary E. Elkins
*Attorney, Agent, or Firm*—Arnold, White & Durkee

[57] ABSTRACT

A container in the form of a six-sided enclosure having opposing top and bottom walls, opposing side wall inner panels which are hingedly connected to opposing edges of the bottom wall, and opposing end walls formed from a corrugated or solid fibreboard blank. A pair of flaps are hingedly connected to opposing sides of each of the end walls and are adapted to overlie an adjacent side wall inner panel. A pair of side wall outer panels are hingedly connected to opposing edges of the top wall and each is adapted to overlie the flaps which overlie the adjacent side wall inner panel.

8 Claims, 3 Drawing Sheets 24
30
36
98
96
94
38
26
40
36
80
64
58
56
46
56
48
94
32
60
66
42
36
44
94
98
96
28
68
36
62
94
82
50
98
52
34
54
54

FIBREBOARD CONTAINER FOR FRESH PRODUCE

This application is a continuation of application Ser. No. 07/879,877, filed May 7, 1992.

BACKGROUND OF THE INVENTION

1. Field of the Invention

The present invention relates generally to corrugated or solid fibreboard containers. More specifically, the present invention relates to corrugated or solid fibreboard containers which are particularly adapted for storing fresh produce such as asparagus.

2. Description of the Prior Art

Several problems are associated with the storage and transportation of fresh produce such as asparagus and the like. Asparagus is a fast growing spear which continues to grow after it is harvested during its active growth period. Asparagus spears have fragile tips which are easily broken or damaged when the asparagus is packed or stored. The spears can also bend during shipping unless their tapered shape is supported along its length. After packing, the asparagus must be hydrocooled with ice water to retard continued growth and prevent the asparagus from becoming limp and withered.

Specialized containers have been designed to store and transport asparagus without damage. Asparagus is typically stored in wooden crates of trapezoidal cross section to accommodate the tapered shape of the asparagus spears. Wooden crates provide a durable container with sufficient stacking strength to prevent damage to the fragile asparagus during transportation and storage. Extra space is provided above the asparagus tips for the continued growth of the asparagus after harvesting. Openings are provided for cooling and ventilation of the asparagus. However, wooden asparagus containers are costly, difficult to store, require stapling to form the crate and stapling or banding to close the crate after it is packed, and are difficult to dispose of at the retail level.

Corrugated fibreboard asparagus containers have been used as a viable alternative to wooden containers because they are cost effective and collapsible for easy storage. Such fibreboard containers also have several drawbacks. Such containers are often constructed from multiple piece blanks and require stapling or banding in their construction. When the asparagus is unpacked, the staples or banding may become mixed in the asparagus and later harm a consumer. Moreover, these containers generally have inadequate stacking strength causing the asparagus spears to break or bend as the top and bottom walls of the containers weaken when stacked on top of each other.

There exists a need for a container which overcomes the disadvantages associated with conventional asparagus containers. The present invention provides such an improved container design.

SUMMARY OF THE INVENTION

In accordance with the foregoing, it is an object of the present invention to provide a corrugated or solid fibreboard container having adequate strength and shape to store asparagus and the like without damage.

It is a related object to provide an improved corrugated or solid fibreboard container capable of maintaining asparagus spears in a straight and upright position within the container.

Yet another object of the present invention is to provide a corrugated or solid fibreboard container which has improved stacking strength, ease of packing and unpacking, and does not require stapling or banding of the container for closure.

A further object of the invention is to provide a container which has a moisture repellant construction and is capable of hydro-cooling and ventilation of the asparagus.

The above and other objects are realized, in accordance with the system of this invention, by providing a container having recloseable side wall panels, with the container being adapted for the storage of asparagus, as will be described in detail below in conjunction with the accompanying drawings. The container according to the present invention is in the form of a six-sided enclosure having opposing top and bottom walls, opposing side wall inner panels which are hingedly connected to opposing edges of the bottom wall, and opposing end walls formed from a corrugated or solid fibreboard blank, preferably imparted with moisture repellant properties. A pair of flaps are hingedly connected to opposing sides of each of the end walls and are adapted to overlie an adjacent side wall inner panel. A pair of side wall outer panels are hingedly connected to opposing edges of the top wall and each is adapted to overlie the flaps which overlie the adjacent side wall inner panel.

Openings are formed in the flaps, the side wall inner panels and the side wall outer panels such that the openings are in communication when the side wall outer panels overlie the flaps which overlie the adjacent side wall inner panel.

Figure 1:
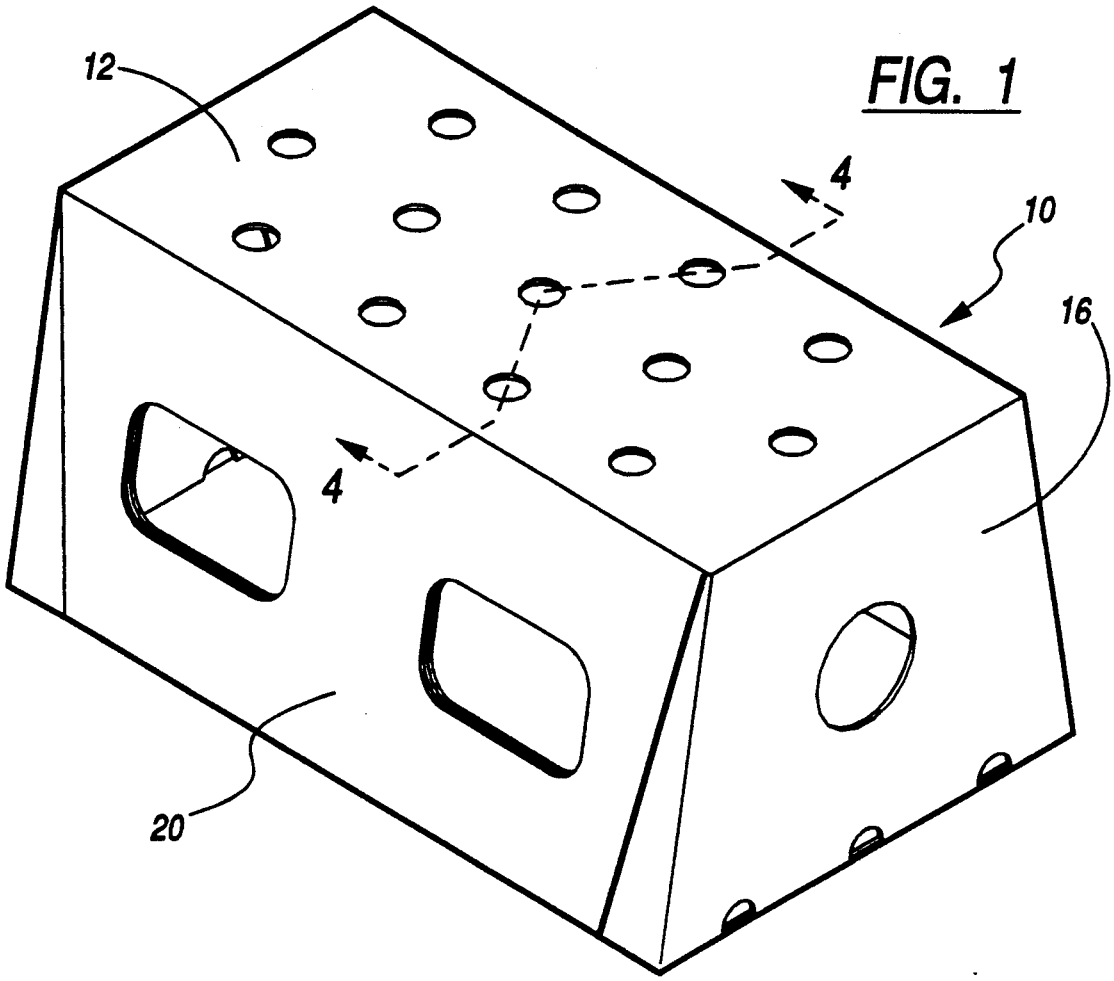
FIG. 1 is a perspective view of a corrugated fibreboard container in accordance with a preferred embodiment of the present invention, the container being in its closed form.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Referring now to the drawings and in particular to FIG. 1, there is shown a perspective view of an exemplary recloseable corrugated fibreboard container having a side wall locking arrangement in accordance with an illustrative embodiment of the present invention. In particular, FIG. 1 shows a container which is a six-sided enclosure of trapezoidal cross section formed of two pairs of opposing rectangular walls and a pair of opposing trapezoidal walls. More specifically, the container 10 includes opposing top and bottom walls 12 and 14 (FIG. 4), respectively, opposing trapezoidal end walls 16 and 18 (FIG. 3), respectively, and opposing side wall panels 20 and 22 (FIG. 3), respectively. The side wall panels 20, 22 of the container are reinforced to provide stacking strength sufficient to prevent damage to enclosed produce, as will be described in detail below with reference to FIGS. 3 and 4.

Figure 2:
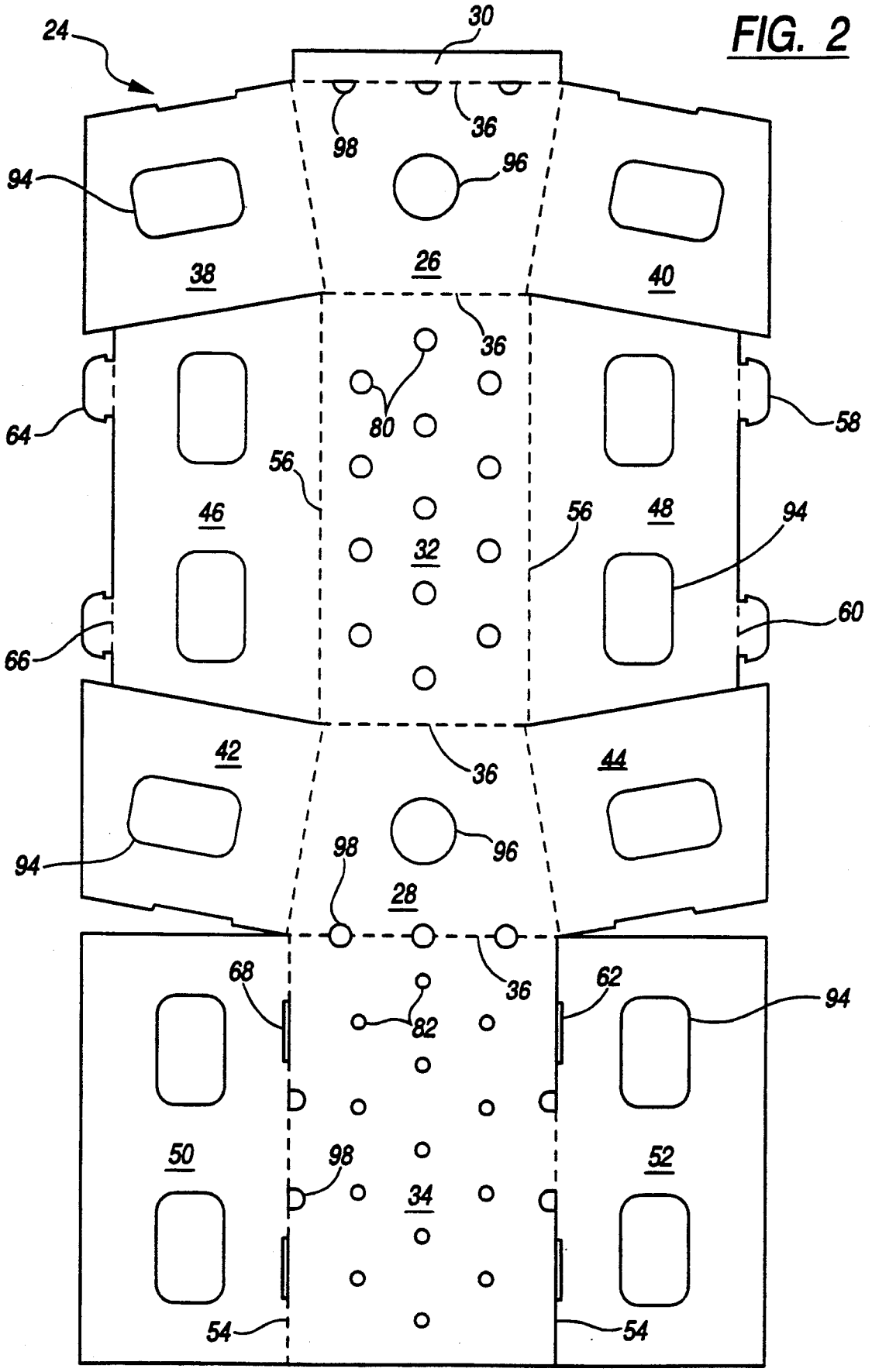
FIG. 2 is a top plan view of the corrugated fibreboard blank used to form the container shown at FIG. 1, according to an illustrative embodiment of this invention.

The recloseable corrugated fibreboard container as shown in FIG. 1 is formed from a precut and scored corrugated fibreboard blank illustrated in FIG. 2. The blank 24 is in the form of a single planar unitary section of corrugated fibreboard which includes two trapezoidal panels 26 and 28 disposed between three rectangular panels 30, 32 and 34 in vertical alignment and linked by horizontal score lines 36 which aid in folding the container panels relative to each other. When assembled, these panels form the container shown in FIG. 1 in combination with associated flaps to be described below. The trapezoidal panels 26 and 28 function as front and back panels, respectively, the panel 32 functions as a top panel, the panel 34 functions as a bottom panel, and the panel 30 functions as a closure flap which is adhered to the panel 34 to form an open-sided sleeve as will be described below.

Each of the trapezoidal panels 26, 28 and the rectangular panels 32, 34 is provided with a pair of flaps connected along respective transverse edges by means of score lines. More specifically, the front panel 26 is provided with a left end flap 38 and a right end flap 40. Likewise, left and right end flaps 42 and 44 are respectively associated with the back panel 28. The top panel 32 includes left end flap 46 and right end flap 48, and left and right end flaps 50 and 52 are respectively associated with the bottom panel 34. The end flaps 38, 40, 42, 44, 50, 52 have substantially the same transverse dimensions. However, the end flaps 46, 48 corresponding to the top panel 32 have transverse dimensions which are smaller than the corresponding dimensions of the other flaps. The end flaps 46, 48 and 50, 52 function as the side wall outer panels and side wall inner panels, respectively, when the blank 24 is assembled to form the container shown in FIG. 1.

In order to assemble the container illustrated in FIG. 1, the trapezoidal panels 26, 28 and the rectangular panels 30, 32, 34 are first folded relative to each other forming an open-sided sleeve (not shown). More specifically, the trapezoidal panel 28 is positioned perpendicular to the panel 34 about the corresponding score line. Panel 32 is folded about a corresponding score line until it is perpendicular to the trapezoidal panel 28. Likewise, trapezoidal panel 26 is positioned perpendicular to the panel 34. The panel 30 is folded downwardly and inwardly in order to be adhered, by means of an appropriate glue or like adhering means, to the lower transverse edge of the panel 34, i.e., the surface of the panel 34 that is hidden from view beneath end wall 16 in FIG. 1. The top and bottom walls 12, 14 and end walls 16, 18 of the container 10 are assembled to provide the container 10 in a fully open condition.

The open-sided sleeve formed as described above is then completed into the form of the container 10 by appropriately folding in the outwardly extending end flaps and fixing end flaps 46, 48 in a locking arrangement. It will be understood by those skilled in the art that this assembly is preferably performed in two stages: first, closing one side of the box, and next filling the box with the requisite contents prior to closing the remaining side of the box to yield a closed container as disclosed in FIG. 1.

As illustrated in FIGS. 1 and 2, the container 10 in its closed form is an enclosure of trapezoidal cross section formed by opposing top and bottom walls 12, 14 (FIG. 4) which are respectively defined by the top and bottom panels 32, 34, opposing trapezoidal end walls 16, 18 (FIG. 3) respectively defined by the trapezoidal panels 26, 28, and opposing side walls 20, 22 (FIG. 3) respectively defined by (i) the combination of flap 50, opposingly folded flaps 38, 42 and flap 46, and (ii) the flap 52, opposingly folded flaps 40, 44 and flap 48.

The side walls 20, 22 of the container 10 are formed by folding the end flaps into a locking arrangement. Right end flap 52 is folded upwardly about the score line 54 until the flap contacts the right edge of the top wall 12 about the score line 56. Subsequently, right end flaps 40, 44 are folded inwardly to overlie flap 52, and right end flap 48 is folded downwardly to overlie end flaps 40, 44. The overlying side wall flaps are held in a closed position by a locking arrangement. Locking tabs 58 extending from the edge of the right end flap 48 opposite score line 56 are folded inwardly about score line 60 and inserted into slot 62 along the score line 54 adjacent right end flap 52 to hold the side wall flaps 48, 40, 44, 52 in place. The back side wall of the container 10 as assembled is shown in FIG. 3.

Figure 3:
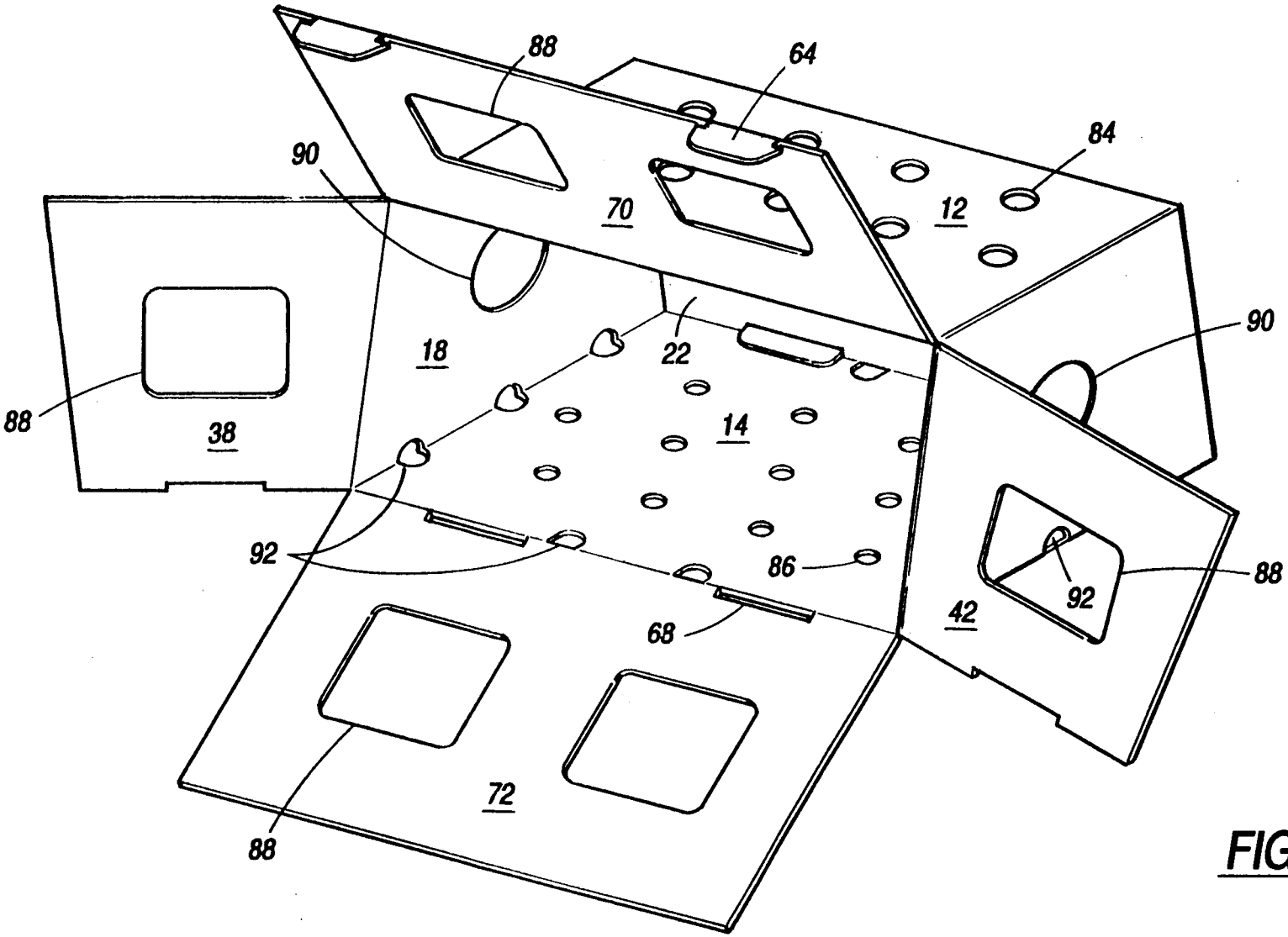
FIG. 3 is a perspective view of the container of FIG. 1, as shown in an open condition with the side wall outer panel raised upwardly, the end flaps moved outwardly, and the side wall inner panel lowered downwardly to open the container.

The front side wall of the container 10 is shown in an open position in FIG. 3. The front side wall is formed by folding left end flap 50 upwardly about the score line 54 until the flap contacts the left edge of the top wall 12 about the score line 56 (FIG. 2) as is described above for the right side wall. Next, left end flaps 38, 42 are folded inwardly to overlie flap 50 and left end flap 46 is folded downwardly to overlie end flaps 38, 42. Locking tabs 64 extending from the edge of the left end flap 46 opposite score line 56 are folded inwardly about score line 66 (FIG. 2) and inserted into slots 68 along the score line 54 adjacent left end flap 50 to hold the side wall flaps 46, 38, 42, 50 in place.

Alternatively, the side walls 20, 22 are formed by folding end flaps 40, 44 and 38, 42 inwardly, folding respective end flaps 52 and 50 upwardly to overlie end flaps 40, 44 and 38, 42, and folding end flaps 48 and 46 downwardly to overlie respective end flaps 52 and 50. Locking tabs 58 and 64 are inserted into respective slots 62 and 68 as discussed above.

Figure 4:
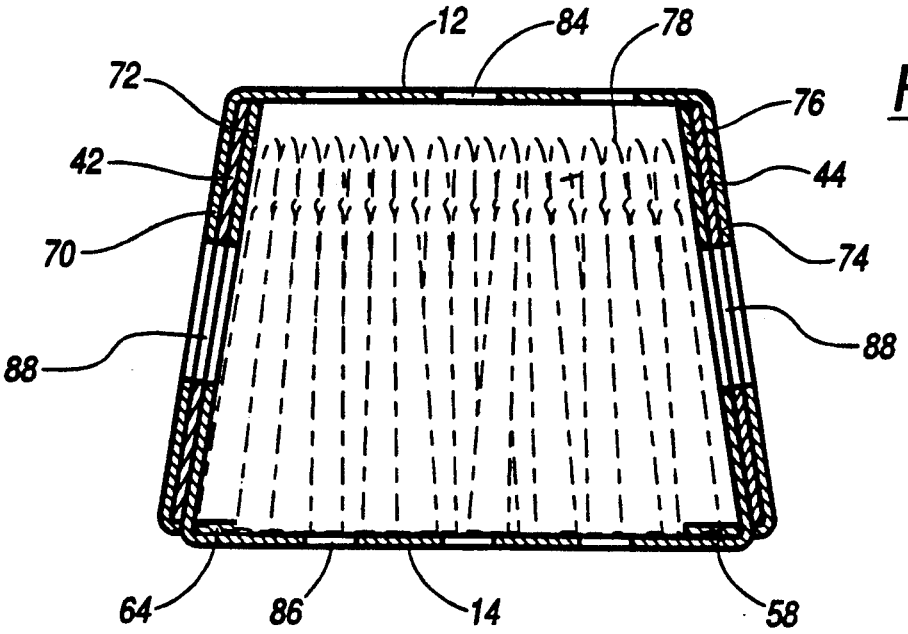
FIG. 4 is a cross-sectional view taken along line 4—4 in FIG. 1 and illustrating the side wall locking arrangement according to the system of the present invention.

Referring now to FIG. 4, there is shown an illustration which facilitates an understanding of the manner in which the side wall recloseable locking arrangement functions in accordance with the system of the present invention. As particularly shown in the cross-sectional view of FIG. 4, when the container is in its closed condition, the end flaps extending from the panels of the blank 24 fold with respective to each other to form three ply reinforced side walls. The left end flap 42 is positioned between the end flaps 46 and 50 which function as the side wall outer panel 70 and the side wall inner panel 72, respectively. Locking tab 64 extends from the bottom edge of the side wall outer panel 70 beneath the end flap 42 through slot 68 (FIG. 3) to lock the side wall 20 (FIG. 1) in place. Likewise, the right end flap 44 is positioned between the end flaps 48 and 52 which function as the side wall outer and inner panels 74 and 76, respectively. The side wall 22 is locked in place by locking tab 58 which extends from the bottom edge of the side wall outer panel 74 beneath the end flap 44 through slot 62 (FIG. 2).

The three ply construction of the side walls 20, 22 strengthens the container 10 to withstand forces exerted on it during stacking preventing weakening of the container and consequent damage to its contents. While the corrugations of the flaps 42, 44 extend horizontally, the side wall outer and inner panels 70, 74 and 72, 76 have vertical corrugations such that the overlapping triple ply side walls are stronger due to increased rigidity in both the horizontal and vertical directions. The strengthened side walls 20, 22 prevent the asparagus 78 from breaking during shipment or storage. The trapezoidal configuration of the container 10 serves to protect the asparagus by tapering toward the tip portion of the asparagus to hold the asparagus vertically within the container, reducing abrasion to the asparagus.

Furthermore, the side wall locking arrangement as shown in FIG. 4 enables the container 10 to be repeatedly opened and closed without the use of staples or banding as is conventional in the art. Once the panel 30 of the open-sided sleeve described above is adhered to the lower transverse edge of the bottom wall 14, no additional closure means is required. The open-sided sleeve configuration of the container may be flattened prior to packing or after unpacking for storage convenience by simply contacting the inner surface of one of the trapezoidal end walls 16, 18 to the inner surface of the bottom wall 14 causing the sleeve to close to a flattened position. The container can later be unflattened to resume the open-sided sleeve structure and the side walls can be formed as detailed above. Accordingly, the container can be provided to a user in flattened form for ease of assembly without requiring gluing, stapling or banding by the user.

An additional feature of the container 10 as shown in FIGS. 1–4 are openings in the panels and end flaps for ventilation, hydro-cooling and display of the asparagus packed within the container. Openings 80 and 82 (FIG. 2) in the respective top and bottom panels 32, 34 of the blank 24 function as hydro-cooling openings 84 and 86 in the top and bottom walls 12, 14, respectively, of the container 10 (FIG. 3). Ice water that cascades onto the top wall 12 and down the side walls 20, 22 of the container 10 during hydro-cooling flows through openings 84, openings 88 in the side walls 20, 22, and openings 90 in the end walls 16, 18 to cool the asparagus before exiting through openings 86 in the bottom wall and the drainage openings 92 along the lower transverse edge of the end walls 16, 18 and the left and right edges of the bottom wall 14. The openings 88, 90, 92 correspond to respective openings 94, 96, 98 (FIG. 2) of the blank 24. The openings as shown in FIGS. 1–4 are by way of illustration and could be altered in shape or position by one skilled in the art. It is noted, however, that openings 88 in the end flaps of the container are positioned such that the openings along each side of the container are in communication with each other when the container is in a closed position to facilitate ventilation, hydro-cooling and display of the asparagus.

The openings throughout the container 10 are useful in ventilating and hydro-cooling the enclosed produce to reduce heat within the container. Additionally, the openings 88, 92 serve as a display means so that the asparagus can be viewed by a purchaser. The openings 92 also function as handles for moving the container. The trapezoidal shape of the container also facilitates ventilation and hydro-cooling in that air or water can readily escape the vertically aligned asparagus. The container also provides additional space above the asparagus tips for the continued growth of the asparagus after harvesting.

The container 10 is packed with loose or bunched asparagus or the like when one of the side walls 20, 22 is in an open position. The container is placed on a horizontal, flat surface or in a V-shaped trough-like support with the right edge of the bottom wall 14 disposed at the nadir of the support such that the container is tilted at an angle for filling. Asparagus is loaded vertically into the container such that the asparagus tips are in a straight and upright position parallel with the narrow edge of the trapezoidal interior. Subsequently, the open side wall of the container is closed to form the closed container as shown in FIG. 1. Since asparagus is generally hydro-cooled for several minutes after it is packed, the container 10 is formed from a moisture repellant material such as wax cascaded corrugated fibreboard to prevent weakening of the container from moisture exposure.

The closed containers can be palletized in various ways. For example, containers holding thirty pounds of asparagus are palletized by placing three containers horizontally along the center of the pallet and two containers vertically along the left and right sides for the first layer, placing three containers horizontally along the left half and two vertical rows of containers along the right half for the second, fourth and sixth layers, and placing two vertical rows of containers along the right half and three containers horizontally along the right half for the third, fifth, and seventh layers of a seven layer arrangement. Alternating the position of the containers in a palletizing arrangement better distributes the weight of the containers throughout the arrangement as is known in the art. The palletizing arrangement as described is given by way of example and alternative palletizing arrangements can be readily determined by one skilled in the art.

The containers of the present invention, while being particularly suited for storage of asparagus, may be used for storage of other fresh produce such as celery, rhubarb, and the like.

We claim:

1. A container formed from a unitary continuous corrugated or solid fibreboard blank for the storage of asparagus, comprising:

opposing top and bottom walls;

opposing end walls;

opposing side wall panels hingedly connected to opposing edges of the top wall;

opposing side wall panels hingedly connected to opposing edges of the bottom wall; and a pair of flaps hingedly connected to opposing sides of each of the end walls wherein each flap is in communication with one of the side wall panels connected to the top wall and one of the side wall panels connected to the bottom wall when the carton is closed.

2. The container of claim 1 wherein the end walls are trapezoidal.

3. The container of claim 2 wherein openings are formed in the flaps and the side wall panels such that the openings are in communication with each flap is in communication with one of the side wall panels connected to the top wall and one of the side wall panels connected to the bottom wall.

4. The container of claim 3 further including tabs, formed along a bottom edge of the side wall panels connected to the top wall, in locking engagement with slots formed in the opposing edges of the bottom wall.

5. The container of claim 4 further including a closure panel hingedly connected to a bottom edge of one of the end walls such that the closure panel overlaps and is fixedly attached to an adjacent end of the bottom wall.

6. The container of claim 5 further including openings formed in the top wall and corresponding openings formed in the bottom wall.

7. A corrugated or solid fibreboard blank comprising:

a pair of trapezoidal panels, each having a pair of flaps hingedly connected to opposing longitudinal edges of each of the trapezoidal panels; and a pair of rectangular panels, each having a pair of flaps hingedly connected to opposing longitudinal edges of each of the rectangular panels, the panels being hingedly connected to each other in a longitudinal direction along parallel score lines, and the flaps of the rectangular panels having transverse edges of a length equal to a length of the opposing longitudinal edges of the trapezoidal panels.

8. The blank of claim 7 wherein openings are formed in the panels and the flaps.

* * * * *